United States Patent [19]

Baldanello et al.

[11] 4,372,367

[45] Feb. 8, 1983

[54] ROLLER BLINDS

[76] Inventors: Umberto Baldanello, 44 Via Meucci; Giuseppe Zottino, 276, Via Roma, both of Spinea, Italy

[21] Appl. No.: 151,287

[22] Filed: May 19, 1980

[30] Foreign Application Priority Data

Jun. 12, 1979 [IT] Italy ..... 12637 A/79
Oct. 16, 1979 [IT] Italy ..... 84145 A/79

[51] Int. Cl.[3] ..... A47G 5/02; E06B 9/204
[52] U.S. Cl. ..... 160/310; 242/55
[58] Field of Search ..... 160/310, 311, 309; 74/568 T, 670; 192/142 R, 139; 242/55, 57, 54 R

[56] References Cited

U.S. PATENT DOCUMENTS 2,800,536 7/1957 Farmer ..... 74/568 T X
3,285,089 11/1966 Tsugawa ..... 160/310 X
4,172,563 10/1979 Werner et al. ..... 160/310 X

*Primary Examiner*—Philip C. Kannan
*Attorney, Agent, or Firm*—Marvin Feldman; Stephen E. Feldman; Jules L. Chaboty

[57] ABSTRACT

A roller blind includes a reversable electric motor disposed in and arranged to drive a roller winder via a reduction gear to roll-up and unroll the blind. The motor is switched off at an open and closed position of the blind by limit switches actuable by a control device drivable with the winding roller. The control device includes at least one actuating mechanism provided with first and last rotatable members. The first rotatable member can be brought into geared connection with the winding roller and the last rotatable member is associated with at least one of the limit switches and is provided with an actuator member to actuate the limit switches. The maximum rolling or unrolling-up length of the roller blind is arranged to correspond to an angular rotation of the last roller of less than 360°.

5 Claims, 7 Drawing Figures

ROLLER BLINDS

INTRODUCTION TO THE PRESENT INVENTION

The present invention relates to a roller blind or the like with an electrical drive and automatic control, wherein a reversible electric drive motor connected to a winding roller by means of a reduction gear is mounted in a motor gear holder fixed in a stationary position inside the winding roller, and wherein this motor is automatically switched off in the open and closed positions of the roller blind by means of limit switches and a control means acting on the limit switches and drivable in geared down manner synchronously with the winding roller.

In the known roller blinds of this kind, the control means for the limit switches for automatically switching the drive motor off in the open and closed positions of the roller blind consists of a lead screw driven directly or indirectly via the reduction gear by the drive motor of the winding roller, whilst this lead screw moves a spindle nut, which is non-rotatably guided and mounted thereon and forms the actuating member for two limit switches, back and forth between the switches. This construction is very bulky and takes up a great deal of space and can therefore only be housed with considerable difficulty in the roller blind casing or inside the hollow cylindrical winding rollers. Moreover, this roller blind cannot be used in relatively narrow and high window and door openings where the length of roller blind to be unrolled and rolled up and hence the length of the lead screw which is dependent thereon are relatively great. The known control means with a lead screw and spindle nut as the actuating member for the limit switch also has the disadvantage that the operation of the switch and hence the switching off of the electric drive motor in the closed and open positions of the roller blind are fairly inaccurate and difficult to set up or adjust.

AN OBJECT OF THE PRESENT INVENTION

An object of the present invention is to provide a roller cover apparatus where the control means for the limit switches for automatically switching off the drive motor in the closed and open positions of the roller cover not only results in very simple and accurate setting or adjustment of the operation of the limit switches but is also as small as possible in construction and can readily be mounted and installed at any desired point.

SUMMARY OF THE PRESENT INVENTION

According to the present invention there is provided a roller blind or the like comprising: a blind rollable and unrollable between an open and a closed position, a winding roller for rolling and unrolling said cover, a motor gear holder disposed within said winding roller, a reversible electric drive motor disposed within said motor gear housing, reduction gear means drivably connecting said motor to said winding roller, limit switches to switch said motor on and off when said blind is at said open and closed positions, and control means gearably drivable by the winding roller to actuate said limit switches to start and stop said motor, wherein said control means comprises at least one actuating mechanism provided with a first rotatable member and a last rotatable member which is drivably connected to said first rotatable member and which is provided with a limit switch actuator, wherein said control means is disposable to allow said first rotatable member to be driven by said motor and said switch actuator of said last rotatable member to actuate said limit switches, and wherein said blind has a maximum length of rolling and unrolling corresponding to an angular rotation of said last rotatable member of less than 360°.

The control means has very small dimensions and can therefore be mounted at any desired point, and more particularly—in an advantageous embodiment of the invention—in a bearing housing at one end of the winding roller. Also the actuating mechanisms permits very accurate and easily adjustable actuation of the limit switches. Moreover, the actuating mechanisms may be produced in a variety of forms and are an inexpensive product which can easily be adapted to the particular requirements of the invention without any difficulty.

The control means may comprise only a single actuating mechanism which is associated with two limit switches which can be actuated alternately by the last roller in two different angular positions of this roller by means of at least one switch actuator provided thereon. However, in an advantageous embodiment of the invention, the accuracy of switching of the control means may be further increased by providing two limit switches each having an associated actuating mechanism, one of these limit switches being constructed to switch off the drive motor in the closed position of the roller blind whilst the other is constructed to switch off the drive motor in the open position of the roller blind. This embodiment also permits particularly easy setting up and adjustment of the exact moment at which each of the two limit switches should be actuated in the associated open or closed position of the roller blind. For this purpose, in a preferred embodiment of the invention, each actuating mechanism is provided with a manually operated zero-setting apparatus and in its zero position it actuates the associated limit switch to switch off the drive motor. In this case, in order to set or adjust the automatic control of the roller blind, it is merely necessary to bring the roller blind first into the open position, for example, and then into the closed position, and to set the associated actuating mechanism to zero in each of these two positions by actuating the relevant zero setting apparatus.

BRIEF DESCRIPTION OF THE DRAWINGS

Embodiments of the present invention will now be described by way of example and with reference to the accompanying drawings in which.

DESCRIPTION OF PREFERRED EMBODIMENTS

Figure 1:
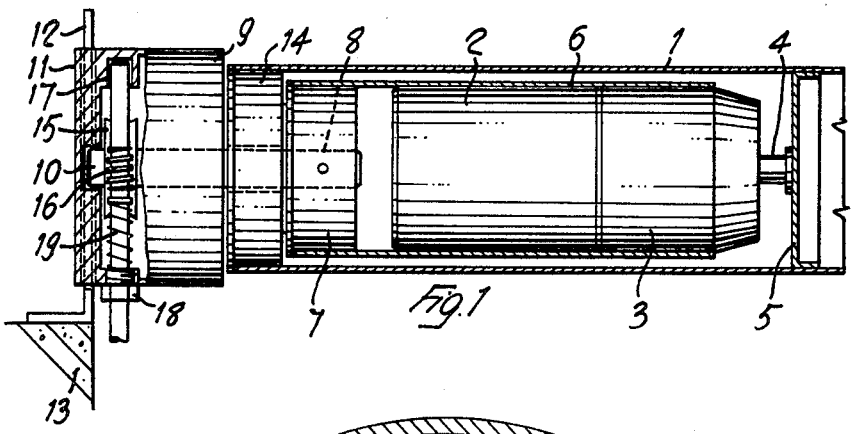
FIG. 1 shows a vertical longitudinal section through the end portion of the winding roller of a roller blind embodying to the present invention.
Figure 3:
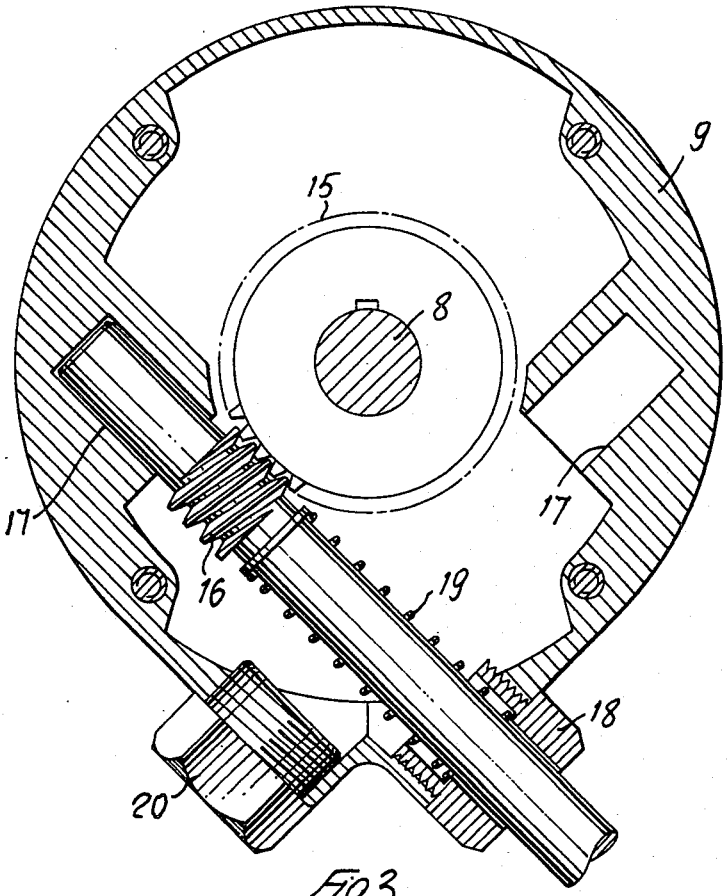
FIGS. 3, 4, 5 and 6 are cross sections on the lines III—III, IV—IV, V—V and VI—VI in FIG. 2.
Figure 2:
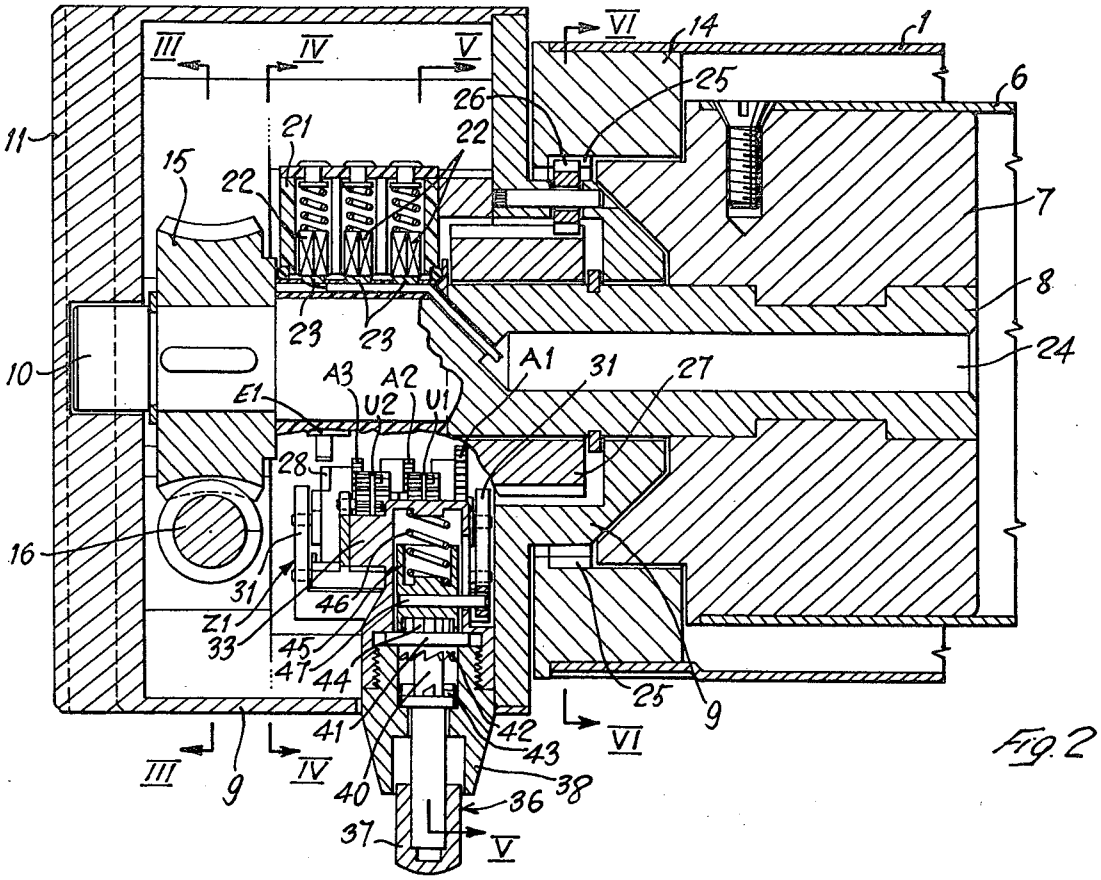
FIG. 2 shows a vertical longitudinal section through the end bearing housing of the winding roller shown in FIG. 1, on a larger scale.

In the drawings, reference numeral 1 designates the winding roller of a roller blind or other similar apparatus, such as, for example, a roll-down door, a roller awning, roller grating, or the like. The winding roller 1 is hollow in construction and the drive means for the roller blind is mounted therein, near one of its ends. The drive means consist of a reversible electric drive motor 2 which drives a self-locking reduction gear 3. The driven shaft 4 of the reduction gear 3 is non-rotationally connected to the winding roller 1 via a connecting disc 5. The drive motor 2 and the reduction gear 3 are mounted in a tubular motor gear holder 6 the outer diameter of which is smaller than the internal diameter of the winding roller 1. This tubular motor gear holder 6 is fitted, with its outwardly directed end, i.e. its end remote from the drive motor 2 and reduction gear 3, on a cover bush 7 and is non-rotationally connected thereto. The cover bush 7 itself is non-rotationally mounted on the roller blind spindle 8 corresponding to this end of the winding roller 1. This spindle 8 is passed through the stationary bearing housing 9 at the end and is rotatably mounted with its end pin 10 in the outer cover 11 of the bearing housing. The bearing housing 9 is secured, via the cover 11 and by means of an angle section 12 or the like, to the lateral boundary wall 13 of the window or door opening. The hollow winding roller 1 is fitted by its end on a support ring 14 and is non-rotatably connected thereto. The support ring 14 is mounted between the bearing housing 9 and the cover bush 7 at the end of the motor gear holder 6 and is mounted in freely rotatable manner on the stepped-down end portion of the cover bush 7.

A worm wheel 15 with which a worm 16 engages is fixed to the roller blind spindle 8 in the bearing housing 9. The worm 16 is rotatably mounted with the inner end of its pin in a corresponding bearing bore 17 and passes through a screwed ferrule 18 and out of the bearing housing 9. This worm 16 can be operated manually, e.g. using a hand crank (not shown) which is articulated at its outer end. The worm gear formed by the worm 16 and the worm wheel 15 is self-locking in construction and constitutes an auxiliary gear for rolling the blind up and down manually if there is a power cut. Because of the self-locking of the worm gear 15, 16, the tubular motor gear holder 6 is held in a non-rotatable manner by the roller blind spindle 8 and cover bush 7 during normal operation of the roller blind. Consequently, the drive motor 2 mounted therein is able to drive the winding roller 1 via the reduction gear 3 which is also mounted in the motor gear holder 6. The winding roller 1 rotates with its terminal support ring 14 on the fixed cover bush 7 of the stationary motor gear holder 6. During a power cut, the roller blind spindle 8 is rotated via the worm 16 and the worm wheel 15 and this spindle 8 also causes the motor gear holder 6 with the drive motor 2 and the reduction gear 3 to rotate, via the cover bush 7. Since the reduction gear 3 is self-locking, it also drives its driven shaft 4 and hence the winding roller 1 as well. Thus, when the roller blind is manually operated by means of the worm gear 16, 15 the roller blind spindle 8 also rotates, together with the motor gear holder 6 and the entire drive means (drive motor 2 and reduction gear 3), which rotates the winding roller 1 by means of the self-locked driven shaft 4 and the connecting disc 5. Obviously, the winding roller 1 can be rotated both in the rolling-up direction and in the unrolling direction by means of the manually operable worm gear 16, 15.

The worm 16 may be mounted in the bearing housing 9 so as to be longitudinally movable to a limited extent and may be held in its position of engagement with the worm wheel 15 in at least one direction by a compression spring 19. When the end position is reached, i.e. the worm wheel 15 cannot rotate any further, in at least one direction of rotation of the worm 16, e.g. when the roller blind is rolled up, the worm 16, which may have rotated further, moves in the longitudinal direction counter to the force of the compression spring 19 until it moves out of engagement with the worm wheel 15. This prevents damage to the worm gear 16, 15 or to the reduction gear 3.

Arranged symmetrically to the bearing bore 17 and to the through-bore, provided with the screwed ferrule 18, for the worm 16, there are provided in the bearing housing 9 another bearing bore 17 and another through-bore for the worm 16, the latter being closed off by a screw 20. As a result, it is possible to mount the same bearing housing 9 or the entire control means with the drive means for the roller blind either at the right or—as shown—at the left hand end of the winding roller 1, as desired.

Since the otherwise stationary roller blind spindle 8 rotates when the winding roller 1 is operated manually, the supply of current to the drive motor 2 inside the winding roller 1 is effected through an axial bore 24 in the roller blind spindle 8 and via three brushes 22 mounted in a fixed portion 21 of the bearing housing 9 and associated slip-rings 23 fixed in insulated manner to the roller blind spindle 8.

In the bearing housing 9 there are two limit switches E1, E2 each of which is associated with a roll counting mechanism Z1, Z2, respectively, as the control means. The roll counting mechanisms Z1, Z2 are driven by the winding roller 1 via a common reduction gear. In the embodiment shown by way of example, that portion of the support ring 14 rotating with the winding roller 1 which projects at the end beyond the cover bush 7 of the motor gear holder 6 has internal teeth 25, with which a plurality of intermediate wheels 26 engage, these wheels 26 being mounted in freely rotatable manner in the bearing housing 9 and distributed in the circumferential direction. A central toothed wheel 27 mounted in freely rotatable manner on the roller blind spindle 8 and driving the two roll counting mechanisms Z1 and Z2 meshes with these intermediate wheels 26.

Figure 7:
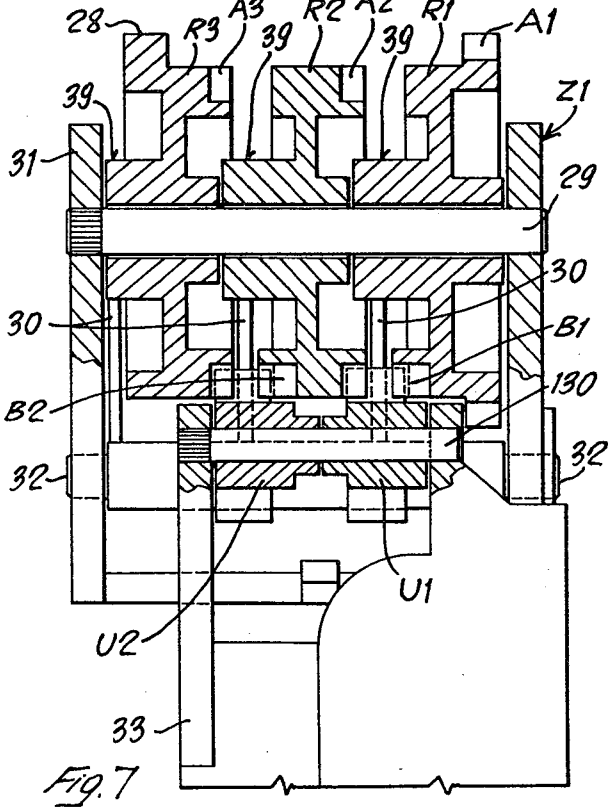
FIG. 7 shows a section through a roll actuating mechanism, on a larger scale.
Figure 6:
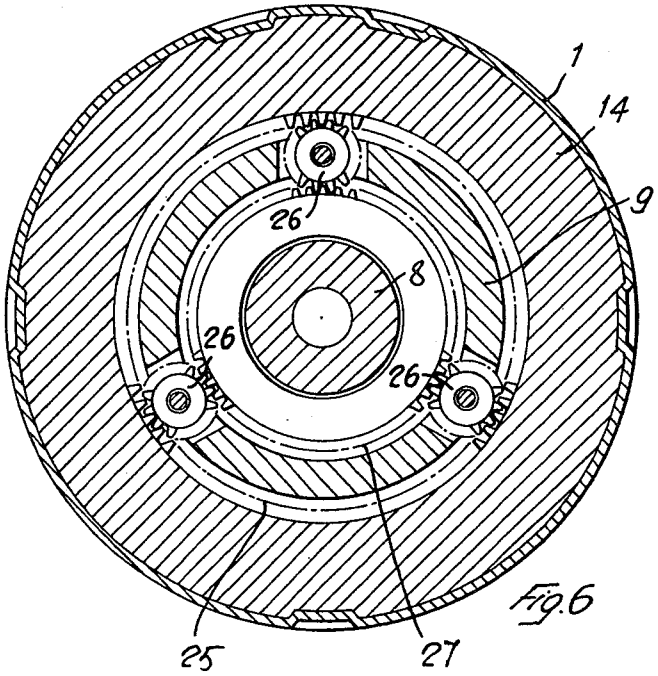

In the embodiment shown, each roll actuating or counting mechanism Z1 or Z2 consists of three rotatable members or counting rollers R1, R2, R3 mounted in freely rotatable manner on a common spindle 29 and associated with two intermediately mounted transmission rollers U1, U2, mounted in freely rotatable manner on a common axis 130, as shown in FIG. 7, in particular. The first counting roller R1 has a toothed driving rim A1 projecting circumferentially which can engage with the central toothed wheel 27. The first transmission roller U1 cooperates with a transmission tooth B1 of the first counting roller R1 and a toothed driving rim A2 of the second counting roller R2. In the same way, the second transmission roller U2 cooperates with a transmission tooth B2 of the second counting roller R2 and a toothed driving rim A3 of the third counting roller R3. The third counting roller R3 comprises a circumferentially projecting lug 28 for actuating the associated limit switch E1 or E2. The reduction gear 25, 26, 27 and the roll counting mechanism Z1, Z2 are constructed so that the maximum length of rolling up or unrolling the roller blind corresponds to a partial rotation of the last counting roller R3 of less than 360°.

Figure 4:
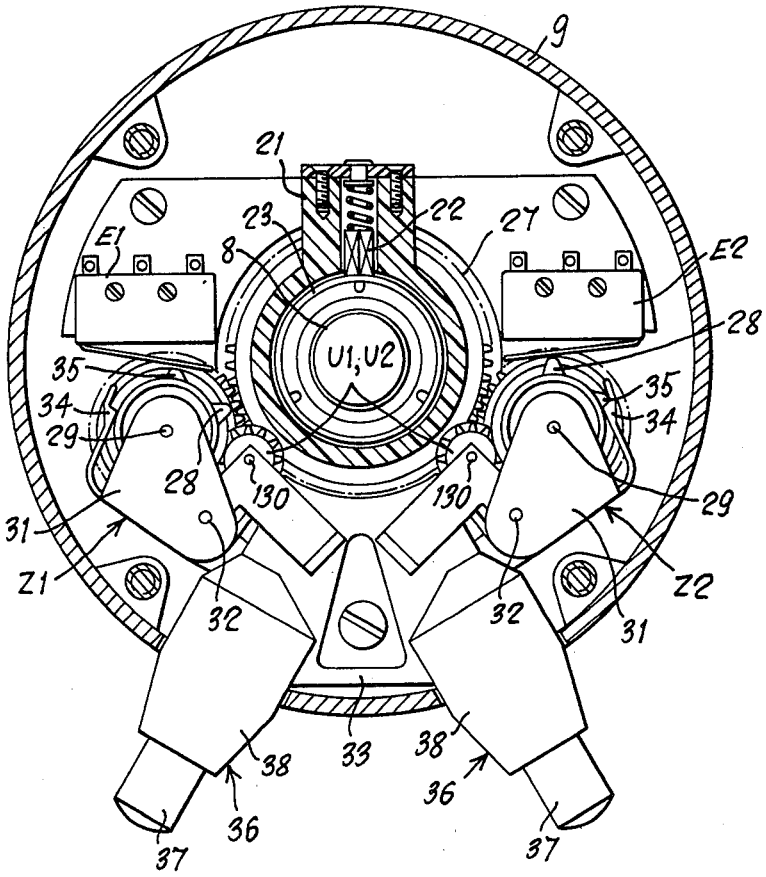
Figure 5:
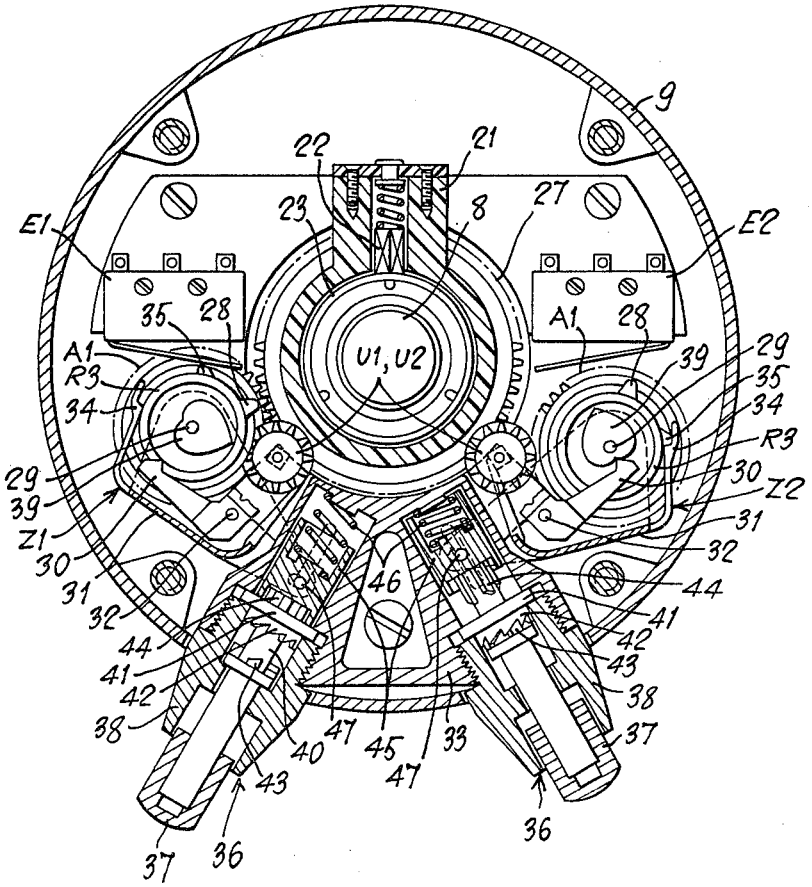

Each roll counting mechanism Z1 or Z2 is provided with a manually operated zero setting means. For this purpose, each counting roller R1, R2, R3 comprises on its side a heart-shaped zero-setting cam 39, formed thereon, for example, which cooperates with an associated zero-setting tappet 30. The counting rollers R1, R2, R3 and their rotation spindle 29 are mounted in a carrier bracket 31 which is pivotable about the axis 32 away from and towards the associated limit switch E1 or E2. The transmission rollers U1, U2 with their rotation axis 130, however, are fixedly mounted on a stationary support member 33 which is secured in the bearing housing 9. The zero-setting tappets 30 engaging in the manner of a comb between the counting rollers R1, R2 and R3 are also attached to this support member 33. The carrier bracket 31 with the counting rollers R1, R2, R3 can alternately take up an outward position for the right-hand roll counting mechanism Z2 shown in FIG. 5 and an inward position for the left-hand roll counting mechanism Z1 in FIG. 5 and for the two roll counting mechanisms Z1 and Z2 in FIG. 4. In the inward position, pivoted inwards toward the associated limit switch E1 or E2 and the toothed wheel 27, the toothed driving rim A1 of the first counting roller R1 engages with the central toothed wheel 27 and the counting rollers R1, R2, R3 are in the position of engagement relative to the fixedly mounted transmission rollers U1, U2. The zero-setting tappets 30 are lifted away from the associated heart-shaped zero-setting cams 39. The projecting lug 28 of the last counting roller R3 travels along a path on which it can engage with the associated limit switch E1 or E2 and actuate said switch. In the outward position of the roll counting mechanism Z1 or Z2, however, in which it is pivoted away from the associated limit switch E1 or E2 and from the toothed wheel 27, the toothed driving rim A1 of the first counting roller R1 is moved outwards from the central toothed wheel 27. The projecting actuating lug 28 of the last counting roller R3 is retracted from the associated limit switch E1 or E2 and cannot actuate this switch. Moreover, all the counting rollers R1, R2, R3 are moved away from the associated fixedly mounted transmission rollers U1, U2 and can therefore rotate freely. At the end of the outward pivoting of the carrier bracket 31, the zero setting tappets 30 press against the heart-shaped zero-setting cams 39 of the associated counting rollers R1, R2, R3 and thereby rotate all the counting rollers into their zero position, in which each zero-setting tappet engages in a planar recess in the associated heart-shaped zero-setting cam on the side diametrically opposite the tip of the cam. The last counting roller R3 provided with the actuating lug 28 for the limit switch E1 or E2 is, moreover, held in its zero position by a resilient locking pawl 34 fixed, or more particularly formed, on the bracket 31 and cooperating with a circumferentially projecting retaining tooth 35. The arrangement is such that the last counting roller R3 of each roll counting mechanism Z1 or Z2 actuates the associated limit switch E1 or E2, via its projecting lug 28, precisely at the moment when this counting roller R3 is in the zero position and when the carrier bracket 31, i.e. the relevant counting mechanism Z1 or Z2, has pivoted into the inward position, toward the limit switch E1 or E2.

The pivoting of the carrier bracket 31 of each roll counting mechanism Z1 or Z2 into the inward or outward position is effected selectively by means of an associated manually operated adjusting device 36. In the embodiment shown by way of example, each adjusting device 36 is constructed similarly to the push-button mechanism for a ball-point pen or the like, and consists of a push button 37 which is guided rotatably and axially movably in a push-button housing 38. The push-button shaft 40 is passed through a locking disc 41 mounted in non-rotatable manner in the push-button housing 38, comprising saw-tooth like end teeth 42 on its outwardly directed end. The push-button shaft 40 is provided with matching sawtooth-like teeth 43 directly inwardly, i.e. towards the end teeth 42 of the locking disc 41. The broader, inner end 44 of the push-button shaft 40, i.e. the end located on the inside of the locking disc 41, and the bore in the locking disc 41 for the passage of the push-button shaft 40 have the same shape in cross section, e.g. a polygonal or star-shaped profile. The inner end 44 of the push-button shaft 40 cooperates with a slide 45 guided in the push-button housing 38, this slide being acted upon by a return spring 46 and being in geared connection with the pivotable carrier bracket 31 of the associated roll counting mechanism Z1 or Z2 via a cam pin 47 projecting laterally out of the push-button housing 38 and movable in a longitudinal slot.

When the push button 37 is in an angular position in while the profile of the broadened end portion 44 of the push-button shaft 40 coincides with the profile of the non-rotational locking disc 41, the push-button shaft 37 is able to penetrate with its end portion 44 at least partially into the bore of the locking disc 41. Consequently, the return spring 46 is able to push the slide 45 and push button 37 outwards into an outward position which corresponds to the inward position of the pivotable carrier bracket 31 and the associated roll counting mechanism Z1 or Z2, as shown particularly in the left-hand half of FIG. 5. When the push-button 37 is pushed in, first the end portion 44 of the push-button shaft 37 is forced out of the locking disc 41 and then the teeth 43 of the push-button shaft 40 come into engagement with the teeth 42 of the locking disc 41, whilst the push button 37 is rotated so that the profile of the end portion 44 of the push-button shaft 40 no longer coincides with the profile of the passage bore in the locking disc 41. The push-button shaft 40 thus moves the slide 45 inwards counter to the force of the return spring 46 into an inward position which corresponds to the outward position of the pivotable carrier bracket 31 and the associated roll counting mechanism Z1 or Z2, as shown in the right-hand half of FIG. 5, in particular. The push button 37 and slide 45 are automatically held in this retracted or pushed-in position, since the profiled end portion 44 of the push-button shaft 40 cannot engage in or through this locking disc 41 owing to the angular displacement of its profile relative to the profile of the passage bore in the locking disc. Thus, the associated roll counting mechanism Z1 or Z2 is also held in its outward position and can only be returned to the inward position if the push button 37 which after being pushed in, has now sprung back to some extent, i.e. until disengagement of the two sets of end teeth 42, 43 occurs, if briefly pushed back in i.e. pushed in again fully. In this way, the teeth 43 of the push button shaft 40 again move into engagement with the teeth 42 of the locking disc 41 and rotate the push button 37 so that the profile of the end portion 44 of the push button shaft 40 again coincides with the profile of the passage bore in the locking disc 41. The push-button shaft 40, the push button 37 and the slide 45 can therefore be moved back to their outward starting position by the return spring 47, whilst the carrier bracket 31 with the associated roll counting mechanism Z1 or Z2 is pivoted into the inward position. Obviously, an alternative embodiment is also possible wherein the locking disc 41 is rotatably mounted and the push button 37 is guided so as to be only axially movable, i.e. not rotatable.

Each push button housing 38 consists partly of the common support member 33 and a housing portion inserted therein. The push buttons 37 of the two adjusting devices 36 project from the bearing housing 9 and are in the most accessible position possible, e.g. on the underside of the bearing housing 9.

Let us assume that the limit switch E1 is intended to switch off the drive of the winding roller 1 in the unrolled i.e. let-down closed position of the roller blind and the limit switch E2 is intended to switch off the drive of the winding roller 1 in the rolled up, i.e. pulled-up open position of the roller blind. The automatic control means for the roller blind is set as follows to the appropriate height of the window or door opening, i.e. to the appropriate length of roller blind which is to be rolled down and up. The roller blind is let down into its closed position, for example, and the roll counting mechanism Z1 corresponding to the associated limit switch E1 is first briefly pivoted into the outward position and then back into the inward position, by actuating it twice, i.e. by pushing in and letting out the relevant push button 37. In this way the roll counting mechanism Z1 is set to zero when pulled out and, after being pushed in, is brought into precisely the position which actuates the limit switch E1. The roller blind is then moved into its rolled up open position and the roll counting mechanism Z2 corresponding to the associated limit switch E2 is set to zero by actuating the appropriate push button 37 as described above and is brought into the precise end position which actuates the limit switch E2. The setting is thus effected quickly and easily. The possibility of manual operation of the winding roller 1 by means of the worm gear 15, 16 means that the automatic control can be used even before the electric drive motor 2 is connected up.

What we claim is:

1. A drive mechanism for a winding roller upon which an element is to be wound, comprising:

(a) a motor gear holder disposed within said winding roller;

(b) a reversible electric drive motor disposed within said motor gear holder;

(c) reduction gear means drivably connecting said motor to said winding roller;

(d) a first limit switch actuable to switch off said drive motor in a rolled up position of said element wound on said winding roller, and a second limit switch actuable to switch off said drive motor in an unrolled position of said element wound on said winding roller;

(e) a first and a second control means associated respectively to the said first and second limit switches, each control means being gearably drivable by the winding roller to actuate the respective limit switch, wherein each control means comprises a roll counting mechanism provided with at least two sequentially arranged counting rollers, the first counting roller being gearably connected with the winding roller, and the last counting roller presenting a limit switch actuator for actuating the respectively associated limit switch, and wherein the maximum length between the rolled up position and the unrolled position of said element wound on the winding roller corresponds to a angular rotation of said last counting roller of less than 360°;

(f) a stationary bearing housing provided at one end of said winding roller, inside which bearing housing there are disposed the said first and second limit switches and the said first and second control means; wherein said counting rollers of each roll counting mechanism are each provided with a heart-shaped zero-setting cam cooperable with a zero-setting tappet and are movable relative to fixedly mounted transmission rollers and said zero-setting tappets by a manually operable adjusting device alternately to an inward position and an outward position, whereby in said inward position said counting rollers engage said transmission rollers, said first counting roller is in geared connection with said winding roller, said associated limit switch is actuable by said switch actuator of said last counting roller, and said zero-setting tappets are spaced from said associated zero-setting cams, and whereby in said outward position said counting rollers are spaced from said transmission rollers, said first counting roller is free of said winding roller, said associated limit switch is free from actuation by said switch actuator of said last counting roller, and said zero-setting tappets engage said associated zero-setting cams.

2. A drive mechanism for a winding roller upon which an element is to be wound, comprising:

(a) a motor gear holder disposed within said winding roller;

(b) a reversible electric drive motor disposed within said motor gear holder;

(c) reduction gear means drivably connecting said motor to said winding roller;

(d) a first limit switch actuable to switch off said drive motor in a rolled up position of said element wound on said winding roller, and a second limit switch actuable to switch off said drive motor in an unrolled position of said element wound on said winding roller;

(e) a first and a second control means associated respectively to the said first and second limit switches, each control means being gearably drivable by the winding roller to actuate the respective limit switch, wherein each control means comprises a roll counting mechanism provided with at least two sequentially arranged counting rollers, the first counting roller being gearably connected with the winding roller, and the last counting roller presenting a limit switch actuator for actuating the respectively associated limit switch, and wherein the maximum length between the rolled up position and the unrolled position of said element wound on the winding roller corresponds to an angular rotation of said last counting roller of less than 360°; and (f) a stationary bearing housing provided at one end of said winding roller, inside which bearing housing there are disposed the said first and second limit switches and the said first and second control means, wherein said first counting roller of each roll counting mechanism comprises a toothed driving rim which is engageable with a toothed wheel drivable by said winding roller via a reduction gear and said counting rollers are mounted on a carrier bracket which is pivotable away from and towards said toothed wheel.

3. The drive mechanism according to claim 2 wherein said adjusting device associated with each actuating mechanism comprises a push-button mechanism settable at an advanced and a retracted position.

4. The drive mechanism according to claim 3, wherein said adjusting device associated with each roll counting mechanism comprises a displaceably and rotatably guided push button associated with a push button shaft which extends through a non-rotatably mounted locking disc and comprises sawteeth cooperable with matching sawteeth on said locking disc, whereby on pushing in said push button said push button shaft rotates by one angular step, and whereby said push-button shaft has an end portion gear to said pivotable carrier bracket via a sprung slide and is one of polygonal and star-shaped in cross section, said locking disc is provided with a passage bore having a cross-section of the same profile but corresponding to said cross section of said end portion after every second angular step of said push button shaft.

5. A drive mechanism for a winding roller upon which an element is to be wound, comprising:

(a) a motor gear holder disposed within said winding roller;

(b) a reversible electric drive motor disposed within said motor gear holder;

(c) reduction gear means drivably connecting said motor to said winding roller;

(d) a first limit switch actuable to switch off said drive motor in a rolled up position of said element wound on said winding roller, and a second limit switch actuable to switch off said drive motor in an unrolled position of said element wound on said winding roller;

(e) a first and a second control means associated respectively to the said first and second limit switches, each control means being gearably drivable by the winding roller to actuate the respective limit switch, wherein each control means comprises a roll counting mechanism provided with at least two sequentially arranged counting rollers, the first counting roller being gearably connected with the winding roller, and the last counting roller presenting a limit switch actuator for actuating the respectively associated limit switch, and wherein the maximum length between the rolled up position and the unrolled position of said element wound on the winding roller corresponds to an angular rotation of said last counting roller of less than 360°;

(f) a stationary bearing housing provided at one end of said winding roller, inside which bearing housing there are disposed the said first and second limit switches and the said first and second control means; and (g) further comprising means on which said counting rollers are pivotally mounted so that the first counting roller is pivoted so as to be gearably connected with the winding roller.

* * * * *